United States Patent [19]

Malinowski

[11] Patent Number: 4,568,926

[45] Date of Patent: Feb. 4, 1986

[54] SMOKE DETECTOR

[76] Inventor: William J. Malinowski, Box 274, Bryantville, Mass. 02327

[21] Appl. No.: 609,276

[22] Filed: May 11, 1984

[51] Int. Cl.[4] ..... G08B 17/10

[52] U.S. Cl. ..... 340/630; 250/574; 356/439

[58] Field of Search ..... 340/630; 250/573, 574, 250/575; 356/439

[56] References Cited

U.S. PATENT DOCUMENTS 4,101,785 7/1978 Malinowski ..... 340/630 X

*Primary Examiner*—James L. Rowland
*Assistant Examiner*—Daniel Myer
*Attorney, Agent, or Firm*—Robert E. Ross

[57] ABSTRACT

A smoke detector utilizing a pulsing light source, a photo-voltaic cell, and an amplifier, in which the total current output on each light pulse is a function of the smoke concentration. In a preferred embodiment of the invention, the amplifier output current resulting from each light pulse is converted into an output signal which has a duration which is a function of smoke concentration.

19 Claims, 8 Drawing Figures

SMOKE DETECTOR

SUMMARY OF THE INVENTION

In accordance with this invention, a smoke detector which utilizes a photovoltaic detector device is provided with a transconductance amplifier having a pair of input terminals, an output terminal, and a bias current input terminal in which the amplifier output current, with a particular amplifier bias current, is proportional to the voltage different between the input terminals.

The photovoltaic cell is connected across the amplifier input leads, and a resistance load is also connected across the input leads in parallel with the photovoltaic cell.

In one embodiment of the invention the resistance load is provided by a fixed resistor connected at one end to each amplifier input and a variable resistor is connected in series with the fixed resistors.

A fixed voltage is applied to the tap of the variable resistor so that equal current flow into each input of the amplifier can be established. A bias current is provided into the amplifier bias terminal of a value such that will allow a flow of current into each amplifier input such that by suitable adjustment of the variable resistor, a voltage difference of a predetermined amount may be established between the input terminals.

The resistor network at the input leads serves several functions. First, it provides the necessary load for the photovoltaic device; second, it provides a means for compensation for any amplifier offset voltage between the input leads resulting from manufacturing tolerances of amplifier components, third, it provides a means of adjusting the alarm level of the detector, and fourth, it allows the photo-voltaic device to be isolated from ground, so that voltages generated by external RF noise will exist on both input leads of the amplifier. Since the amplifier operates on a voltage difference between the input leads, stray RF signals likely to be present in the detector environment are unlikely to affect the amplifier output.

Another aspect of the invention lies in the manner of handling the amplifier output. Since the output of an operational transconductance amplifier is, with a particular bias current, a current which is proportional to the voltage difference between the input terminals, and since the light falling on the photo-voltaic device is a pulsed light reflected from smoke particles, any output from the amplifier is a pulse of current, which current, because of the characteristics of the transconductance amplifier, has a constant value during the pulse period. In a preferred embodiment of the invention the output pulse of current is fed to a capacitor and resistor connected in parallel to ground, and also to an electronic switch which requires a predetermined voltage to close. The constant current output charges the capacitor at a linear rate. If the output current during the pulse (which is a function of the smoke concentration) is large enough, it charges the capacitor to a level such that the voltage on the capacitor reaches a predetermined voltage, which atuates the electronic switch to close a circuit that produces an output alarm signal. With higher concentrations of smoke, the amplifier output current during the pulse period is higher and the rate of charging of the capacitor is greater, and therefore the switch is closed sooner in the pulse period. Therefore the time the switch is closed is a function of the smoke concentration. This fact is utilized by suitable integrator circuitry to make the time to alarm an inverse function of smoke concentration.

The circuit thereby provides a "current pump" effect which also serves to increase the immunity of the detector to stray RF signals, since any voltage generated by such signals is averaged by the capacitor and the integrator.

BRIEF DESCRIPTION OF THE DRAWINGS

Referring to FIG. 1 of the drawing, there is illustrated an electronic circuit for use in a smoke detector operating on the reflected light principle. The circuit includes a light emitting diode L and a photovoltaic device such as a photo-diode C positioned out of the direct line of the beam of light from the light emitting diode. In a preferred embodiment of the invention the photodiode C and the light emitting diode L are disposed in a suitable housing, (not shown) with the device C being positioned to view a portion of the light beam in front of the light emitting diode L.

Figure 1:
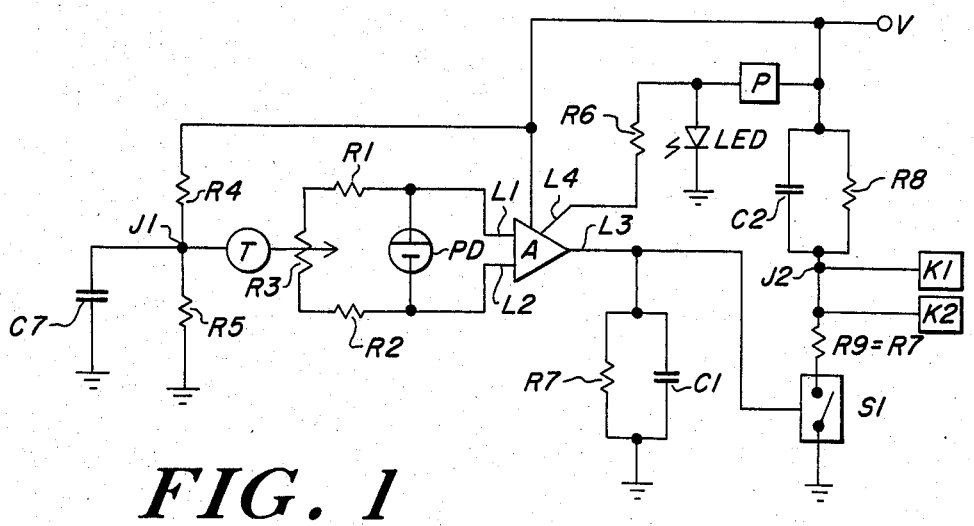
FIG. 1 is a schematic view of electrical circuitry of the illustrated embodiment of the invention.

The output from the photo-voltaic device C is processed by a transconductance amplifier having a pair of inputs L1 and L2, an output terminal L3, and an amplifier bias input terminal L4, and by other circuitry, in a maner to be described.

The photo-voltaic device C is connected across the two inputs L1 and L2 of the amplifier, as are series connected resistors R1, R2, and R3. Resistor R3 is a variable resistor, with a tap T which is connected to the junction J1 of a pair of resistors R4 and R5 connected in series across a power source P.

The amplifier bias current is provided from the power source V through a pulse generator P, which also provides pulses of power to the light emitting diode L, and through a resistor R6 which has a value that will provide a desired bias current into the amplifier of an amount that will allow a desired current to flow from junction J1 through the resistors R1–R3 into the input terminals L1 and L2 of the amplifier for a purpose to appear hereinafter. Since the bias current and the power for the light emitting diode both receive power from the pulse generator P, the bias current is supplied simultaneously with the energization of the light source.

The amplifier output is fed to a capacitor C1 and a resistor R7 which are connected in parallel from the amplifier output L3 to ground. The amplifier output is also connected to the trigger of an electronic switch S1, which controls the flow of current to an RC network I, which controls the operation of an alarm actuating device A.

A transconductance amplifier produces a current output which is a function of the voltage difference between the two inputs (L1 and L2) and of the bias current into the amplifier through terminal L4. For a given bias current, the output current is proportional to the voltage difference between the input terminals, and for a given voltage difference between the input leads, the output current is a function of only the bias current. One characteristic of commercial transconductance amplifiers is the fact that due to manufacturing tolerances, an offset voltage may exist between the input terminals even before an external signal voltage is applied to the input. This offset voltage, which may be greater than the voltage produced by the photodiode when smoke is present, must be compensated for in using the amplifier in a circuit.

In the manufacture of smoke detectors, means must be provided for adjusting the alarm level of the detector, that is, the smoke concentration at which the detector will alarm, and when a photodiode device is used as the detector cell, a suitable resistive load must be provided for the cell. It is also important that the detector be as immune as possible to false alarms from stray RF signals in the detector environment.

In the illustrated embodiment of the detector all of these functions are all provided by the input resistor network, in conjunction with the bias current applied to the bias input terminal as will now be described.

A transconductance amplifier suitable for use in the circuit of FIG. 1 may have an initial offset voltage between the input terminals of between zero and ±5 millivolts, which must be reduced to zero by the resistor network. The resistor network must have a value that will provide the required loading for the photo-voltaic detector cell. Therefore the supply voltage, the amplifier bias network, and the resistors R4 and R5 must have values such that a predetermined amount of current will flow into the input terminals through resistors R1–R3, said predetermined current having a value great enough that by adjustment of variable resistor R3, any offset voltage existing between the input terminals can be reduced to zero.

Therefore when the cell C is exposed to light reflected from smoke, the voltage generated by the cell will cause a voltage difference between the input terminals, which will cause an amplifier output current which is proportional to the voltage generated by the detector cell.

The fact that neither input of the amplifier is connected to ground increases the RF immunity of the detector, since any stray RF signals in the detector environment will affect each input substantially equally, and since the amplifier responds only to a voltage difference between the inputs, the RF signals will not affect the amplifier output.

The electronic switch S1 at the amplifier output may be any one of several types which change state on the application of a predetermined voltage to an input terminal, and returns to the previous state when the voltage is removed.

The capacitor C1 and the parallel resistor R7 have values such that when the smoke concentration reaches an amount of which the alarm is to be actuated, the amplifier output current can charge the capacitor C1 to the required trigger voltage of the switch S1 during the 100 microsecond pulse, and the resistor R7 will allow the charge on the capacitor to bleed off to zero during the 5 second period betweeen pulses.

The operation of the detector is best understood by reference to FIGS. 2–7 of the drawing, in which is illustrated the voltage and condition of various components during operation of the detector.

Figure 2A:
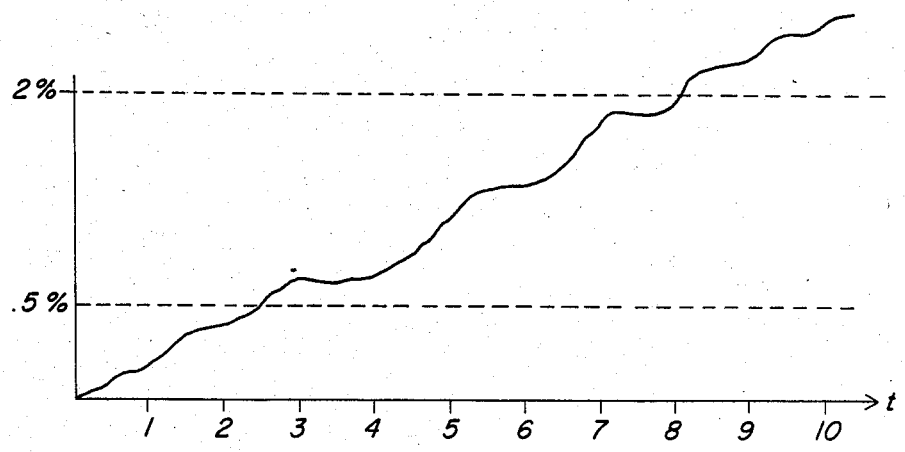
FIG. 2*a* is a graph showing a typical increase in smoke concentration at the detector over a period of time.
Figure 2B:
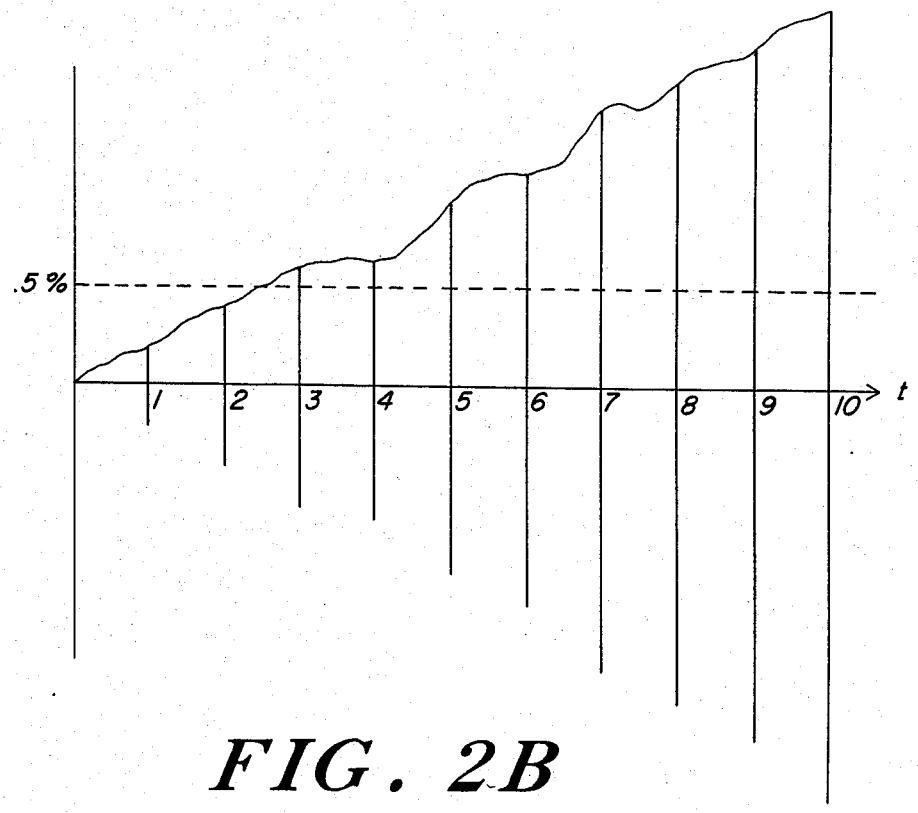
FIG. 2*b* is a graph of the voltage differential produced at the amplifier input on each pulse with the smoke conditions of FIG. 2*a*.
Figure 2C:
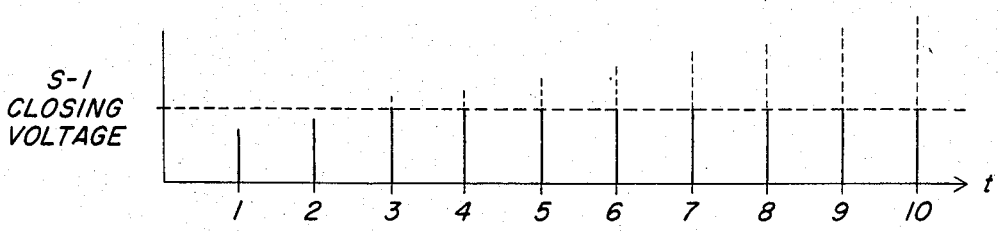
FIG. 2*c* is a graph of the voltage on capacitor C1 produced on each pulse.

FIG. 2*a* is a graph showing a typical increase in smoke concentration at the detector with time. FIG. 2*b* illustrates the offset voltage produced at the amplifier input on each pulse in the smoke conditions of FIG. 2*a*. FIG. 2*c* illustrates the voltage on capacitor C1 produced on each pulse.

Figure 3:
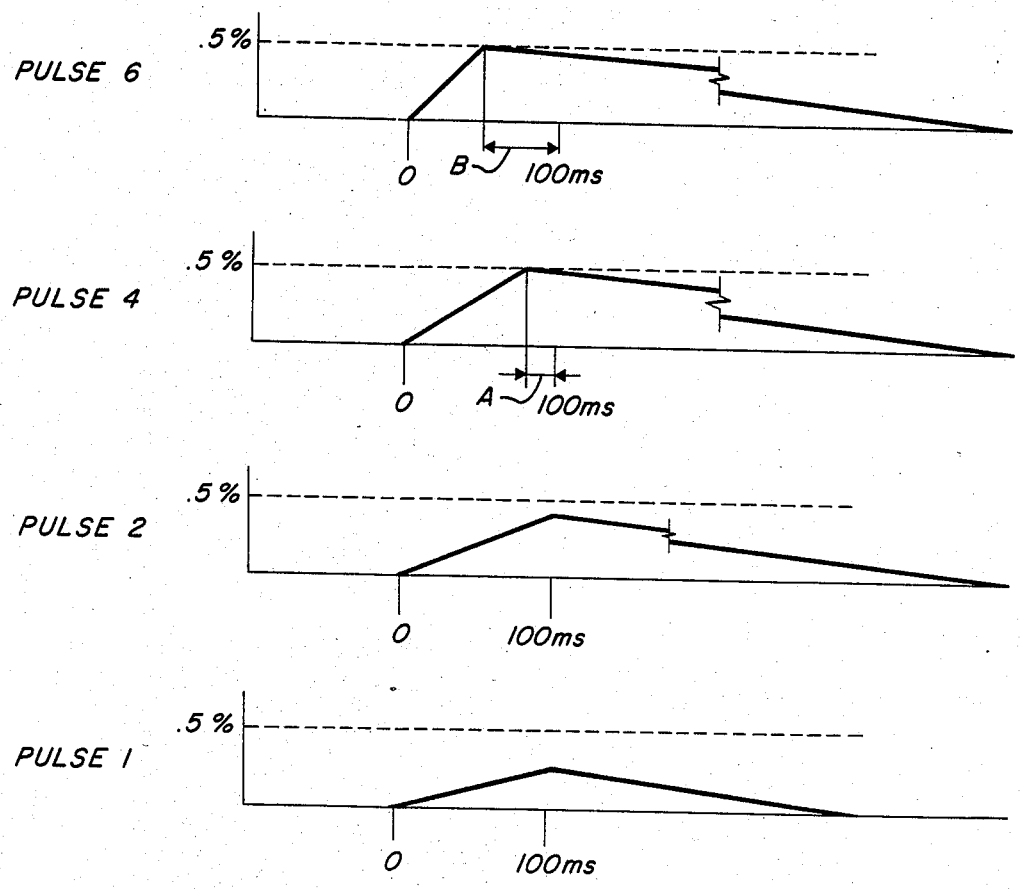
FIG. 3 illustrates the change in voltage on capacitor C1 during certain output pulses from the amplifier.

FIG. 3 illustrates the change in voltage of capacitor C1 during the output pulse from the amplifier at various smoke levels.

Such detectors are commonly set to alarm at 2% smoke, by which is meant the smoke concentration that will obscure 2% of the light in a light beam 1 foot long. However, the switch S1 is designed to close when the voltage at its input reaches a voltage V1 equal to the voltage produced at C1 when the smoke concentration is ½%, for a purpose to be described.

As seen in FIG. 2*b*, as the smoke concentration, as graphed in FIG. 2*a*, increases, the increase in voltage output of the cell C causes an increasing differential voltage between the amplifier input terminals, and as seen in FIG. 2*c*, the resulting amplifier output pulse causes a voltage on capacitor C1 which is greater on each pulse. At pulse #3 and subsequent pulses, the capacitor C1 voltage rises to the voltage level V1 at which the switch S1 is actuated, thereby closing the circuit to the integrator network R8 and C2.

If the switch S1 is a transistor, for example, with the amplifier output voltage being applied to the base, then the voltage on capacitor C1 will never exceed the voltage V1 even though, in the absence of switch S1, the capacitor voltage would rise higher.

Referring to FIG. 3, there is illustrated, on an enlarged scale, the capacitor voltage during pulses 1, 2, 4, and 6. During pulses 1 and 2, the current out of the amplifier causes the rate of charge into the capacitor to be insufficient to reach the S1 trigger voltage V1 during the 100 microsecond pulse. However when the smoke concentration is greater (above ½%) such as during pulses 4 and 6) the rate of charge causes a higher rate of voltage rise on C1 so that the trigger voltage of S1 is reached before the end of the pulse, so that the switch is actuated.

Also, as illustrated in the representation of the capacitor charge during pulses 4 and 6, it is seen that as the percentage of smoke increases, the trigger voltage of S1 is reached earlier in the 100 microsecond pulse. (Compare the length of line "A"0 in FIG. 3, pulse 4 with the length of line "B", pulse 6).

However, if the trigger voltage of the switch is not reached during a pulse, as in the case of pulses 1 & 2, the capacitor voltage but bleeds off through the resistor R7, at a rate such that the capacitor is completely discharged before the next pulse.

Therefore, assuming that the smoke concentration is high enough to cause switch S1 to close, the time the switch is closed during a pulse is a function of the smoke concentration.

The manner in which switch S1 controls the actuation of the alarm A will now be described.

The closing of switch S1 completes a circuit from the power supply V to ground through a resistor R9 and an RC circuit consisting of R8 and C2 in series therewith and in parallel with each other.

The alarm actuating device K is connected at a point J2 between the resistor R9 and the bottom of capacitor C2 and resistor R8, and is designed to provide an alarm actuating output signal if the voltage at J2 falls below a predetermined level.

When the switch S1 is open, there is no charge on C2 and the voltage at J2 is equal to the supply voltage. When switch S1 is closed, a charge commences building up on C2 through R9 so that the voltage at J2 begins to decrease. The longer the switch S1 is closed during a pulse, the lower the resulting voltage at J2 at the end of the pulse. however the voltage J2 rises slowly after the end of the pulse due to the discharging of the capacitor C2 through resistor R8.

As will be described hereinafter, a series of short S1 closings resulting from a low smoke concentration may never cause the detector to go into alarm; pulses in which S1 is closed a greater length may cause an alarm after several pulses, (the exact number depending on the smoke concentration, and pulses during an extremely high smoke concentration can cause an alarm after only two pulses. The time to alarm is therefore inversely proportional to smoke concentration.

In the illustrated embodiment the circuit parameters are such that the amplifier produces sufficient output at a smoke concentration of ½% to close switch S1 at the end of the pulse, however an alarm will not result unless the smoke concentration reaches a concentration of 2%.

Figure 4:
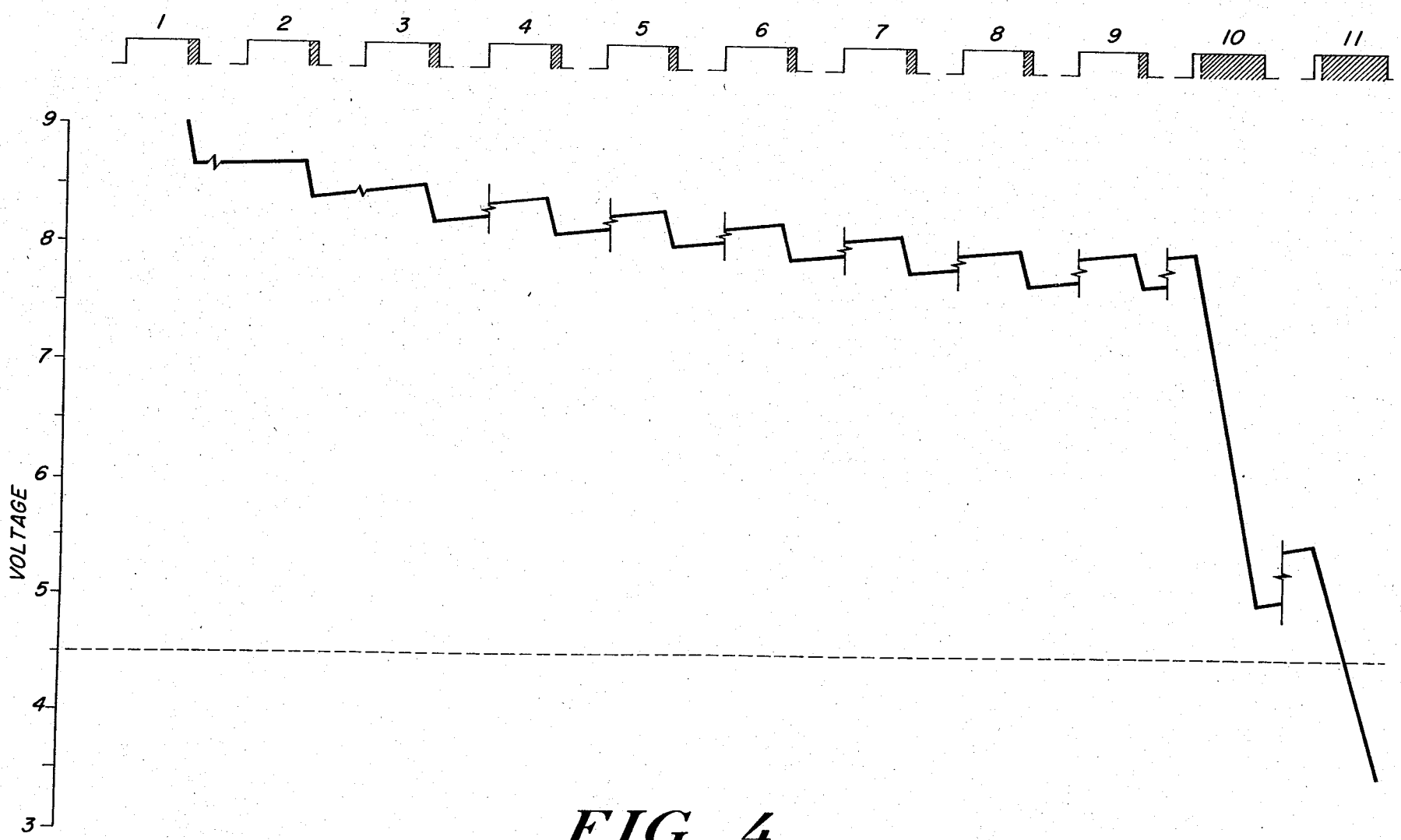
FIG. 4 is a graph of the voltage at J2 during a series of pulses when the smoke concentration at the detector is considerably below the alarm level, followed by pulses during which the smoke concentration has suddenly become considerably higher.
Figure 5:
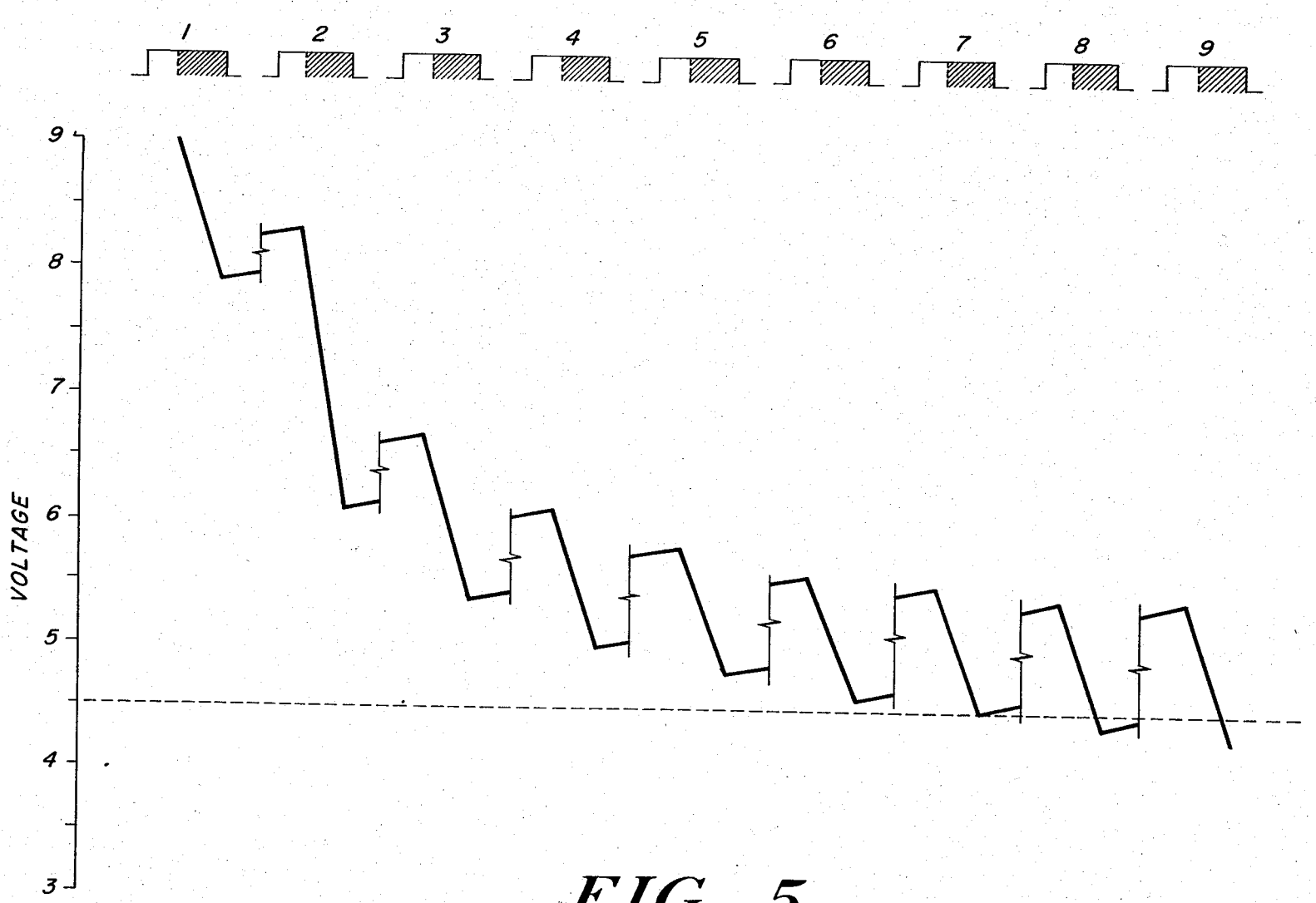
FIG. 5 is a graph similar to FIG. 4 in which the smoke level is just above the alarm level.

FIG. 4 is a representation of a series of pulses occurring when the detector is in an environment containing a smoke concentration of slightly greater than ½%, which provides an amplifier output that causes S1 to close only in the final 10% of the pulse period, or for about 10 microseconds. As illustrated in FIG. 4, each 10 microsecond closing of switch S1 causes the voltage at J2 to decrease by a predetermined amount, however the J2 voltage then increases during the period between pulses due to resistor R8. (Although the pulses are shown close together because of limitations on drawing size, if the distance between pulses were drawn to the same scale as that of the individual pulses, the pulses would be about 4000 feet apart.)

As a series of consecutive pulses each close the switch S1, the voltage at J2 drops on each pulse to a value lower than the value on the previous pulse until the charge on C2 builds up to a point where the voltage drop at J2 on each pulse is equal to the voltage rise at J2 during the time between pulses, and the voltage at J2 then goes no lower.

In the illustrated embodiment, the supply voltage is 9 volts, and the alarm actuating device K1 is set to provide an alarm actuating signal when the input (J2) drops to 4.5 volts. As seen in FIG. 4 closing of switch S1 for 10 microseconds at 5 second intervals will never lower the voltage at J2 to less than about 7.6 volts, and therefore the alarm will never be actuated at this smoke concentration.

However, if the smoke concentration is such that the amplifier output is high enough to cause the switch S1 to close for about the last 60 microseconds of the 100 microsecond pulse, then the balance between the charge accumulated on C2 during the time the switch is closed and the charge lost between pulses is not achieved until the J2 voltage has dropped below 4.5 volts, which occurs on the seventh pulse, assuming that there was no smoke present before the first pulse, and that the level of smoke that provides a switch closing of 60 microseconds suddenly becomes present in the housing of the first pulse.

Figure 6:
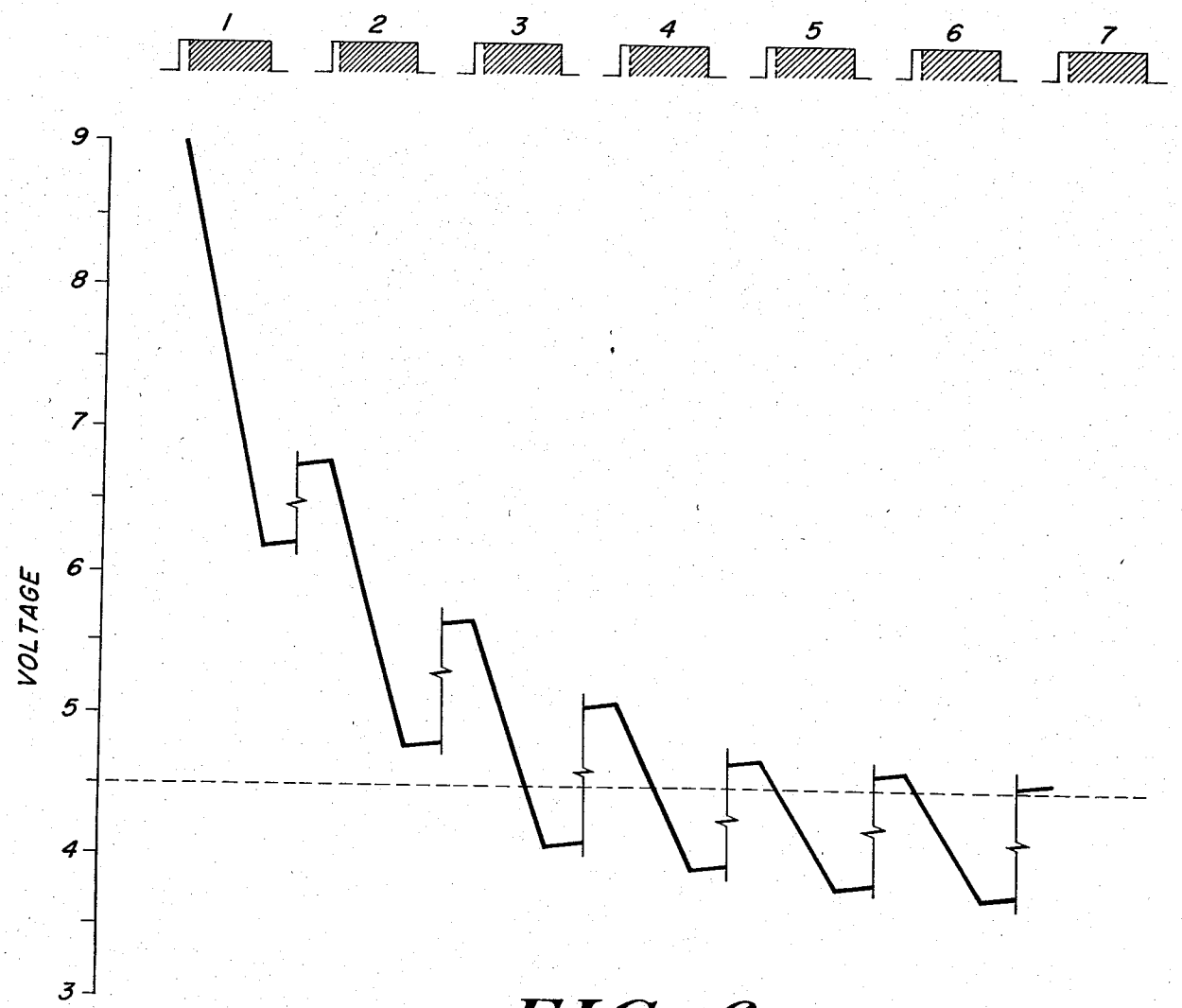
FIG. 6 is a graph similar to FIG. 5 in which the smoke level is greatly above the alarm level.

Higher smoke concentrations will actuate the alarm with fewer pulses, as illustrated in FIG. 6, which represents the J2 voltage when the smoke concentration is high enough to cause the switch S1 to close almost immediately after the start of the pulse, and under these conditions the alarm voltage is reached on the 3rd pulse.

In the most common type of residence fire, a piece of upholstered furniture, set on fire by a tobacco ash, will smolder for a considerable time, giving a low smoke concentration such as represented in FIG. 4. Although it would be a simple matter to reduce the sensitivity of the detector so that it would alarm at a lower smoke concentration, the detector would then tend to false alarm from cooking smoke or tobacco smoke.

The usual detector under such conditions will take the same number of pulses to go into alarm after the smoke reaches 2% after being at 1.5% for some length of time as does in a situation where the 2% smoke appears almost instantly. In other words, the usual detector now in use cannot recognize the fact that the smoke level has been hovering just below the alarm level, and requires the same length of time for an alarm as if there had not been any smoke present at the time the 2% smoke appears.

However, the detector disclosed herein, after having been exposed to a smoke concentration below the alarm level, can provide an alarm on a single pulse if the smoke concentration suddenly exceeds the alarm level. This result is illustrated by the 10th and 11th pulses in FIG. 4. At the smoke concentration of pulses 1–9 of FIG. 4, the voltage of J2 reaches a minimum after about 8–9 pulses. However, when a higher smoke concentration enters the detector, as represented by pulses 10 and 11, the alarm voltage level at J2 can be reached in only one or two pulses, depending on the original smoke concentration and the new smoke concentration.

As illustrated and described, the RC circuit provides a voltage at J2 which is a function of smoke concentration. This fact is utilized to provide an alarm signal, but it may also be utilized to provide a "trend to alarm" signal, by which an indication may be given that a smoke level below the alarm level exists.

For example a second voltage responsive device K2 may be connected to junction J2 which is responsive to a higher voltage, corresponding to a lower smoke concentration than causes K1 to be actuated. For example K2 may be set to provide an output signal when the voltage at J2 drops from the supply voltage of 9 volts to 8 volts. K2 would therefore produce an output signal under the smoke conditions of FIG. 4, indication that a low smoke level exists at the detector location. This modification is particularly useful in installations in which detectors are located in remote unoccupied areas, and connected to a central control panel.

In addition to providing a "trend to alarm" signal, the second voltage responsive device K2 will provide an indication of dust build-up in the detector housing, since as the inside of the housing becomes coated with dust, the housing surface can give a reflection of the light pulse that is similar to the reflection from smoke, and if the dust build-up is severe enough, it can actually give a false alarm. However in the detector disclosed herein, in which a voltage level is established at J2 that is a function of the smoke level, a slow build-up of dust or spider webs in the housing will gradually increase the voltage at J2, which can be indicated by the voltage responsive device K2 long before the alarm point is reached.

In the illustrated embodiment two voltage responsive devices are provided responsive to the voltage at J2 to provide an alarm or signal at different smoke concentrations, however it should be understood that more voltage responsive devices may be provided if desired, and also the rate of change of the voltage at J2 may be utilized in a rate circuit to give an indication of the rate at which the smoke concentration is increasing.

Although the input terminals of the amplifier in the illustrated embodiment are both isolated from ground, it is possible to utilize only one input with the other being grounded, and with the photovoltaic device connected between the input terminal and ground, although such an embodiment would not have the immunity to false alarms from RF signals achieved by the illustrated embodiment, and therefore other measures would have to be taken to reduce false alarms from RF sources.

Since certain other changes apparent to one skilled in the art may be made in the herein described embodiments of the invention without departing from the scope thereof, it is intended that all matter contained herein be interpreted in an illustrative and not a limiting sense.

I claim:

1. A smoke detector of the type comprising a light source, means pulsing the light source at predetermined intervals, and a photovoltaic device positioned to receive light from the light source after said light is reflected from smoke particles, the improvement comprising an amplifier having two input terminals and an output terminal, said amplifier being of the type which produces an output current which is a function of the voltage difference between the input terminals, said photovoltaic device and a resistive load being connected in parallel across the two input terminals, said resistive load having a tap intermediate the ends for connection to a voltage source to enable a desired voltage difference to be established between said terminals.

2. A detector as set out in claim 1 in which said resistive load is a variable resistor with a center tap for connection to a voltage source.

3. A detector as set out in claim 1 in which said amplifier is an operational transconductance amplifier with a bias input terminal and provides an output current which is a function of the bias current and the voltage difference between the two input terminals, in which means is provided for pulsing the bias current on and off simultaneously with the pulsing on and off of the light source.

4. A smoke detector of the type comprising a light source, means pulsing the light source at intervals, and a photovoltaic device positioned to receive light from the light source after said light is reflected from smoke particles, the improvement comprising an amplifier having two input terminals, said amplifier being of the type which produces an output which is a function of the voltage difference between the two input terminals, said photovoltaic device being connected between said two input terminals, and a variable resistor having a tap connected to a voltage source, said variable resistor providing a load for the output generated by the photovoltaic device and allowing adjustment of the voltage between said two input terminals to establish a desired output from the amplifier at a particular smoke concentration.

5. A smoke detector as set out in claim 4 in which said amplifier is an operational transconductance amplifier requiring a bias current and which produces a current output which is a function of the voltage difference between the two input terminals and the value of the bias voltage.

6. A smoke detector as set out in claim 5 which has means for pulsing the bias current on and off simultaneously with the pulsing on and off of the light source.

7. In a smoke detector of the type comprising a light source, means pulsing the light source at predetermined intervals which are long in relation to the pulse duration, a photovoltaic device positioned to view light from the light source reflected from smoke particles, the improvement comprising an amplifier having its input connected to the output of the photovoltaic device, said amplifier being of the type that produces a total current output on each pulse which is a function of the voltage produced by the photovoltaic device.

8. In a smoke detector of the type comprising a light source, means pulsing the light source at intervals which are long in relation to the pulse duration, a photogenerative device and an amplifier of the type that produces a constant current output at a predetermined input so connected and arranged that light from the light source reflected from smoke particles causes a current output pulse from the amplifier during the light pulse, whereby the total current output from the amplifier on each pulse is a function of the smoke concentration.

9. In a smoke detector of the type comprising a light source, means pulsing the light source at intervals which are long in relation to the pulse duration, a photogenerative device and an amplifier of the type that produces a constant current output which is a function of the voltage difference between input terminals, a capacitor receiving the output current during each pulse to establish a voltage ramp at a level detector input, said level detector being responsive to a predetermined input voltage to produce an output signal.

10. A smoke detector of the type having an amplifier that produces output current pulses in which the magnitude of the output current during the pulse at a constant bias current is a function solely of smoke concentration and includes a capacitor for converting the current of each pulse into a voltage which increases proportionally with time during each pulse, a level detector receiving the voltage at its input, said level detector providing an output when the voltage reaches a predetermined level during the pulse, whereby an increase in smoke concentration will produce an increase in current output from the amplifier which will produce an increase in current output from the amplifier which will produce an output from the level detector earlier in the pulse period and the duration of the level detector outout will therefore be a function of smoke concentration.

11. A smoke detector as set out in claim 10 in which the level detector output is fed to an integrator circuit in which the level detector output causes an increase in voltage on a capacitor, means is provided allowing said voltage on the capacitor to decrease at a slow rate between pulses whereby when a smoke concentration at or above a predetermined concentration at which an alarm is to be sounded exists at the detector, the average voltage on the capacitor changes, with the rate and amount of change being a function of the smoke concentration, and means responsive to a predetermined voltage on the capacitor to actuate an alarm.

12. A smoke detector as set out in claim 11 in which a second means is provided which is responsive to a different voltage on the capacitor to actuate a different alarm.

13. A smoke detector of the type comprising a light source, means pulsing the light source at predetermined intervals, and a photogenerative device so arranged that light from the light source reflected from smoke particles causes voltage pulses from the photogenerative device in which the voltage of the pulses is a function of the smoke concentration, the improvement comprising an amplifier having an input receiving said voltage pulses, said amplifier being of the type that produces constant current output pulses in response to said voltage pulses applied to the amplifier input, the amplifier output current during each pulse being proportional only to the voltage of the corresponding voltage pulse applied to the amplifier input, and means utilizing said amplifier output current pulses to create a signal during each pulse which has a duration which is proportional to the amplifier output current during the pulse.

14. A smoke detector as set out in claim 13 in which the amplifier is an operational transconductance amplifier.

15. A smoke detector as set out in claim 13 in which said means utilizing said output current pulse to create a signal during each output pulse includes a switch which changes condition during the pulse period for a time which is proportional to the output current.

16. A smoke detector as set out in claim 15 in which means is provided for integrating the signals created by the change of condition of the switch to provide a signal voltage which is a function of the time the switch is in the changed condition during a series of pulses, whereby said signal voltage is a function of the smoke concentration during said series of pulses.

17. In a smoke detector of the type comprising a light source, means pulsing the light source at predetermined intervals which are long in relation to the pulse duration, a photogenerative device and an amplifier so connected and arranged that light from the light source reflected from smoke particles causes output current pulses from the amplifier, the improvement comprising a switch connected between the amplifier output terminal and an alarm actuating circuit, switch closing means responsive to an applied voltage of predetermined magnitude to close the switch, a resistor and capacitor connected in parallel with each other between the amplifier output terminal and ground, said resistor and capacitor having values such that when a predetermined concentration of smoke exists at the detector, the photogenerative device produces a voltage difference at the amplifier terminals which is great enough to cause an amplifier output current which has a value sufficient to charge the capacitor during a single output pulse to a voltage sufficient to actuate the switch, and such that the charge on the capacitor is reduced to substantially zero during the time between pulses.

18. A smoke detector as set out in claim 17 in which said switch is closed only during the portion of the pulse in which the applied voltage is above said predetermined voltage, whereby the time the switch is closed on each pulse is a function of the smoke concentration.

19. A smoke detector as set out in claim 18 in which said switch when closed completes a circuit to an integrator which creates a voltage at a junction which is a function of the total time the switch is closed in a series of pulses.

* * * * *